United States Patent [19]

Swenson

[11] 4,211,954

[45] Jul. 8, 1980

[54] ALTERNATING PHASE FOCUSED LINACS

[75] Inventor: Donald A. Swenson, Los Alamos, N. Mex.

[73] Assignee: The United States of America as represented by the Department of Energy, Washington, D.C.

[21] Appl. No.: 912,785

[22] Filed: Jun. 5, 1978

[51] Int. Cl.[2] ..... H01J 25/10

[52] U.S. Cl. ..... 315/5.41; 315/5.42

[58] Field of Search ..... 315/5.41, 5.42; 328/233

[56] References Cited

U.S. PATENT DOCUMENTS

| | | | |
|---|---|---|---|
| 2,770,755 | 11/1956 | Good | 315/5.42 |
| 2,836,759 | 5/1958 | Colgate | 315/5.41 |
| 2,867,748 | 1/1959 | Van Atta et al. | 315/5.42 |
| 3,332,024 | 7/1967 | Leboutet | 315/5.41 X |
| 3,710,163 | 1/1973 | Bomko et al. | 315/5.41 |

*Primary Examiner*—Saxfield Chatmon, Jr.
*Attorney, Agent, or Firm*—R. V. Lupo; Paul D. Gaetjens; Jerome B. Rockwood

[57] ABSTRACT

A heavy particle linear accelerator employing rf fields for transverse and longitudinal focusing as well as acceleration. Drift tube length and gap positions in a standing wave drift tube loaded structure are arranged so that particles are subject to acceleration and succession of focusing and defocusing forces which contain the beam without additional magnetic or electric focusing fields.

1 Claim, 6 Drawing Figures

ALTERNATING PHASE FOCUSED LINACS

BACKGROUND OF THE INVENTION

The present invention relates to linear accelerators of the drift tube type known as linac. More particularly the present invention relates to a linac structure which achieves relatively high proton velocities in a short physical distance by means of alternating phase focusing. By employing alternating phase focusing structures in a linac, it is possible to accelerate protons and heavy ions employing higher frequencies, and from lower energies than has been possible heretofore with conventional magnetic quadrupole focus drift tube linac structures. While the acceleration rate is less than in the conventional drift tube structure due to the employment of the accelerating potential for focusing, the overall size and cost of the structure is decreased considerably. Exemplarily, a 400 MHz frequency and a relatively low injection energy of 250 keV may be employed. By arranging the drift tube lengths and gap positions, the particles can be made to experience acceleration and a succession of focusing and defocusing forces which result in a satisfactory containment of the beam without dependence on magnetic focusing fields. Therefore, the drift tubes can be smaller and shorter, allowing the structure to be extended to higher frequencies and lower energies than previously possible.

In the alternating phase focused linac structure, the gap-to-gap distances between drift tubes are arranged so that the particles are exposed to the rf fields at some periodic sequence of phase values alternating from side to side of the peak accelerating phase. This periodic modulation in the gap-to-gap distance implies a period modulation in the drift tube and geometries. These geometries must satisfy a number of constraints related to the dynamics of the particles which are to be accelerated, and the resonant frequency of the resulting structure.

In conventional linacs, the drift tubes include focusing magnets. In the early stages, drift tubes are small due to the relatively low particle velocity and low rf frequency. Therefore, the minimum practicable size drift tube that can be constructed limits the lower limit of required energy of injected ions or protons, and the highest rf frequency which can be employed. Conventional linacs operate at a maximum frequency of approximately 200 Mc, and require particle injection energies of about 750 keV, in order to make the first drift tubes large enough to be manageable.

In contrast to the linacs previously known to the art, the linac of the present invention does not require focusing magnets. They can, therefore, be considerably smaller and simpler than conventional drift tubes. Much lower injected energies are required, exemplarily 250 keV. Higher rf frequencies may be employed, exemplarily 400 Mc. As a result of the higher rf frequency, the tank diameter is halved, from 80 cm to 40 cm.

It will be apparent to one skilled in the art that a structure such as described above results in a smaller, simpler, less expensive linac. Lower injection energies enable much smaller injection systems, a major cost reduction. The higher frequency enables a much smaller diameter, shorter, tank. Further, the drift tubes themselves are much simpler to fabricate and mount. The lower cost, smaller overall structure resulting enables uses of linacs which had previously been prohibitively expensive, such as medical applications.

DESCRIPTION OF THE INVENTION

Figure 1:
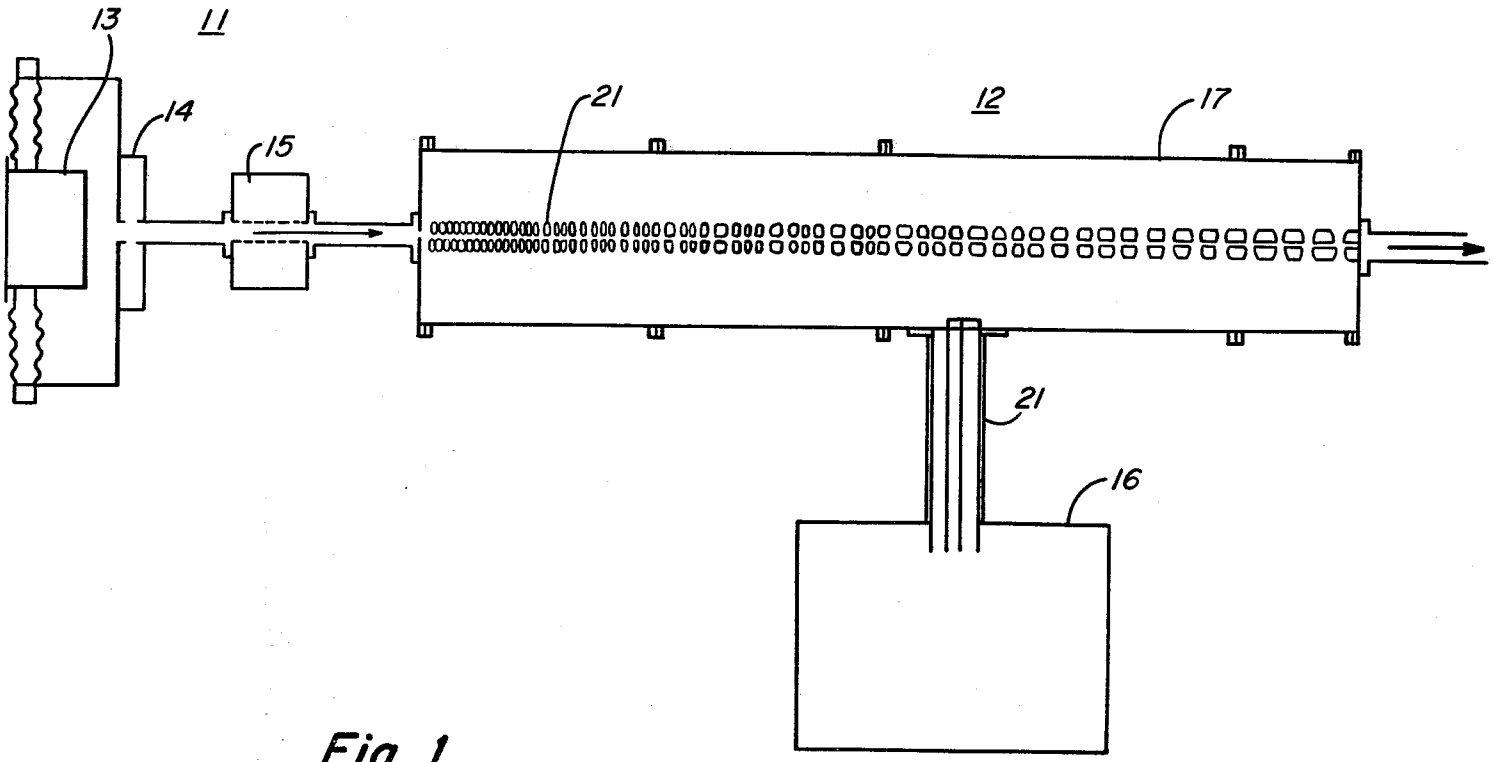
FIG. 1 illustrates an embodiment of an alternating phase focusing linac.

The present approach is to seek an insight into the focusing principle by straightforward simulation of the beam dynamics of long structures with periodic gap phases. The basic properties of such structures can be most readily extracted by degrading the energy gain at each gap by the normal energy gain of the synchronous particle, thus producing structures which are strictly periodic in geometry as well as phases. Particles within the stable phase space of such pseudostructures execute closed oscillations around the synchronous particle which has a constant energy. Phase sequences that exhibit good focal properties in this periodic configuration should constitute good building blocks for practical linacs where the geometry changes as the particles accelerate.

The basic period of the pseudostructure is completely defined by the kinetic (W) and rest ($W_o$) energies of the synchronous particle (constants), the wavelength of the rf, a field factor F related to the product of the average axial electric field $E_o$ and the transit time factor T, the number of gaps per period $N_g$, and the phase of the rf as the synchronous particle crosses each gap $\phi_n$.

Although other possibilities exist, to be disclosed herein are structures where the distance between the n-1st and nth gap is $$d_n = \frac{\phi_n - \phi_{n-1} + 2\pi}{2\pi}\beta\lambda$$

Since the $\phi$'s are periodic, the average spacing between gaps is $\beta\lambda$.

The peak voltage on the nth gap, $V_n$, is taken to be the product of the average axial electric field, $E_o$, and the average value of $d_n$ and $d_{n+1}$.

The transverse dynamics has circular symmetry, making it sufficient to study either transverse plane. The xx' dynamics is dependent on only two equations; one giving the change in x during the drift between gaps, and the other giving the change in x' at the gap. These equations for the nth drift and gap are:

$$\Delta x = d_n x' \quad (1)$$

$$\Delta x' = \frac{-\pi q V_n T \sin\phi_n}{W_o \beta^3 \gamma^3 \lambda} x \quad (2)$$

where $\beta$ and $\lambda$ are the relativistic velocity and mass factors corresponding to the energy of the particle during the nth drift, and $\phi_n$ is the phase of the rf when it arrives at the nth gap.

The longitudinal dynamics is dependent on only two equations; one giving the change in the phase coordinate during the drift between gaps, and the other giving the relative change in the energy of the particle and the synchronous particle at the gap. These equations for the nth drift and gap are:

$$\Delta\phi = 2\pi\left[\frac{d_n}{\beta_s\gamma}\ \frac{\beta_s}{\beta} - 1\right] \tag{3}$$

$$\Delta W = qV_nT(\cos\phi - \cos\phi_n) \tag{4}$$

The $\beta_s/\beta$ term in Eq. (3) can be expressed approximately as $1-\delta W/\beta_s^2\gamma_s^3W_o$ where $\delta W$ is the energy excursion $W\text{-}W_s$. If structure lengths scale as $\beta_s\lambda$ and gap voltages scale as $\beta_s^2\gamma_s^3W_o/q$, one notes that energy excursions go as $\beta_s^2\gamma_s^3W_o$ while the phase excursions are independent of scaling, and the x' excursions go as $1/\beta_s\lambda$ while the x excursions are independent of scaling. The scaling implies that $E_o$ scales like $\beta_s\gamma_s^3W_o/q$.

The area enclosed by the largest stable longitudinal oscillation goes as $\beta^2\gamma^3$. The area (in the canonical variables x and $P_x$) enclosed by the transverse oscillation of a given transverse excursion goes as $\beta\gamma$ time $1/\beta\lambda$ or as $\gamma/\lambda$.

Since the scaling law can be used to transform any basic sequence and excitation to a different synchronous energy, a different wavelength, a different rest mass or a different charge state, the embodiment disclosed is for the nominal values of $W_s=1$ meV, $\lambda=0.75$ meters (400 MHz), and for the rest mass and charge state of a proton.

The excitation and transit time factor for these nominal parameters is referred to as a field factor F, to avoid confusion with the actual value of the product $E_oT$ after scaling. $E_oT$ is related to F by $$E_oT = \frac{\beta\gamma^3W_o/q\lambda}{\beta_n\gamma_n^3W_{o,n/q_n\lambda_n}}F$$

where the subscript n implies the nominal values listed above.

Sixteen basic sequences are presented in Table 1, ranging from two-gap periodicities at the top to eight-gap periodicities at the bottom. Each sequence has a characteristic acceleration factor which is the average value of $V_n\cos\phi_n/E_o\beta\lambda$ over the gaps of the sequence. Within each periodicity, the sequences are arranged in order of decreasing acceleration factor. To the right of each sequence, there are a number of dots corresponding to suitable excitations for the sequence ranging from 0 to 16 MV/m. The asterisks represent the excitations that exhibit the maximum longitudinal stability. The two columns on the right side of the figure give the normalized emittance ($\beta\gamma$ab) of a beam whose maximum diameter is 1 cm, and the total widths of the longitudinal acceptance.

Two things are immediately obvious from this array of sequences:

(1) The range of suitable excitations for a given sequence is relatively narrow, and (2) The optimum excitation of the sequences decreases as periodicity increases.

Given the insight that these studies of the basic sequences provide, the next step is to develop a procedure for using these results to generate practical APF linacs in which the acceleration is allowed to develop.

The scaling law provides guidance for transforming the dots on Table 1 to other energies and other frequencies. Rearranging the relation between F and $E_o$, one gets Table I Array of Basic Phase Sequences With Excitation And Performance Data

Figure 6:
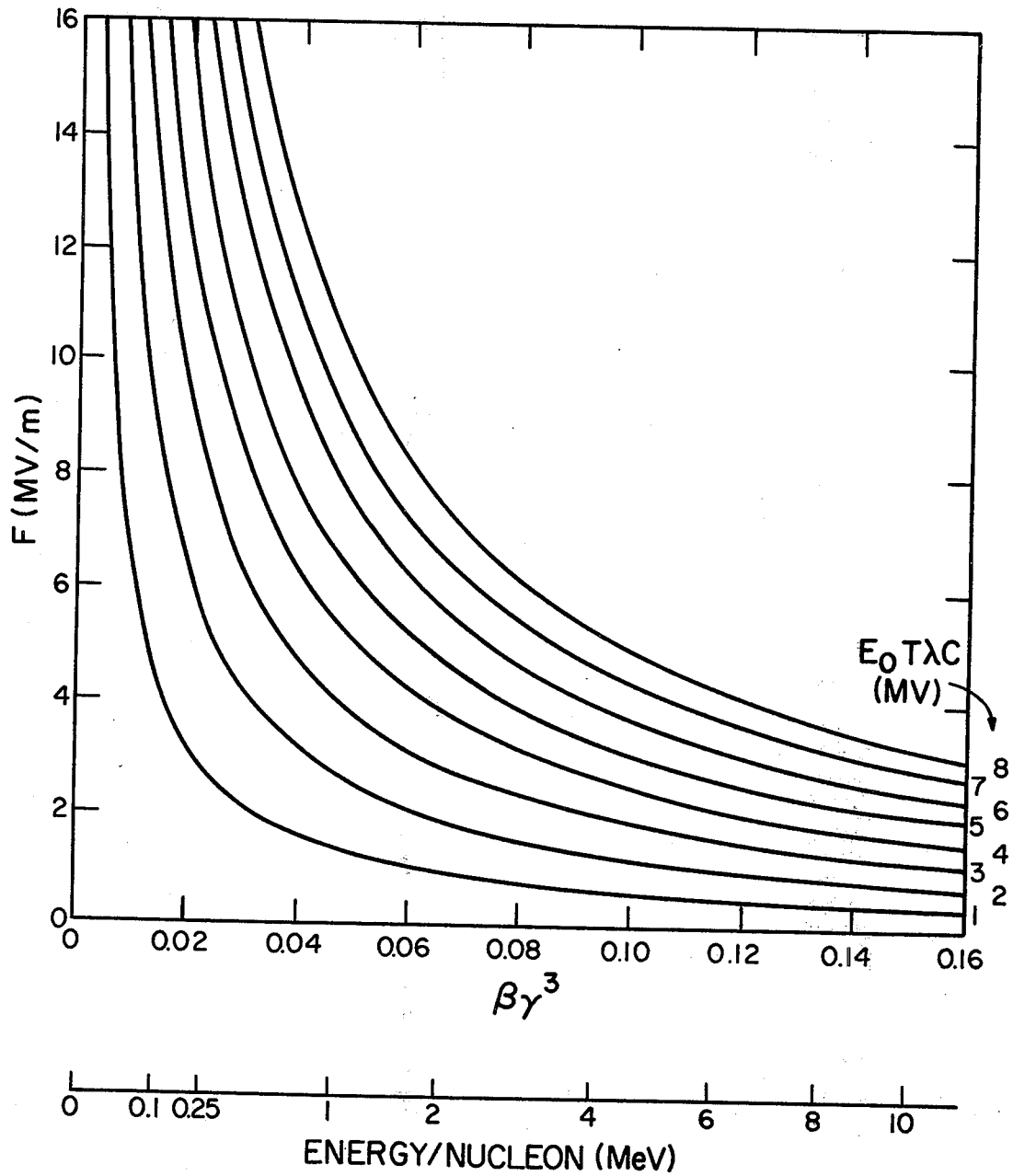
FIG. 6 is a diagram of relationships between parameters of the present invention.

| PERIOD | SEQUENCE (degrees) | ACCEL. FACTOR | FIELD FACTOR F (MV/m) 0 4 8 12 16 20 | X X' ($\beta\gamma$ab) (cm-mrad) | $\phi$ W (total) (deg keV) |
|---|---|---|---|---|---|
| 2 | −60 60 | .500 | | 3.23 | 70 × 200 |
| | −65 55 | .498 | | 2.58 | 86 × 130 |
| | −70 70 | .342 | | 2.93 | 74 × 100 |
| 3 | −90 30 30 | .577 | | 1.83 | 58 × 134 |
| | −90 40 40 | .511 | | 3.60 | 52 × 160 |
| 4 | −90 0 90 0 | .500 | | 1.71 | 60 × 120 |
| | −60 −60 60 60 | .500 | | 1.45 | 50 × 58 |
| | −70 −70 60 60 | .421 | | 1.38 | 70 × 96 |
| 5 | −90 −30 60 60 −30 | .546 | | 0.72 | 60 × 60 |
| | −90 −90 30 90 30 | .346 | | 1.18 | 70 × 64 |
| 6 | −90 −90 0 60 60 0 | .500 | | 0.84 | 65 × 54 |
| | −90 −90 0 70 70 0 | .447 | | 0.96 | 70 × 50 |
| | −90 −90 0 90 90 0 | .333 | | 1.13 | 60 × 50 |
| 7 | −90 −90 0 40 70 40 0 | .553 | | 1.11 | 45 × 26 |
| 8 | −90 −90 −30 30 60 60 30 −30 | .558 | | 0.62 | 62 × 30 |
| | −90 −90 −30 30 90 90 30 −30 | .433 | | 0.81 | 70 × 32 |

$$F \cdot \beta\gamma^3 = \frac{\beta_n \gamma_n^3}{\lambda_n} E_o \lambda C = 0.0617 E_o T \lambda C$$

where $C=(q/W_o)/(q_n/W_{o,n})$ is the charge per nucleon as compared to the proton. It is convenient to define an F, $\beta\gamma^3$ space as shown in FIG. 6, where the hyperbolae are lines of constant $E_oT\lambda C$.

Structure economies and physical limitations would seem to bracket the range of $E_o$'s of interest. Likewise, the range of $\lambda$ is bracketed by rf power considerations and beam and cavity dimensions, T is a function of $\beta,\lambda$ and bore radius, and C is determined by the choice of projectile, and in the case of heavy ions, the resulting charge state. Consequently, $E_oT\lambda C$ is a quantity that tends to be reasonably well bracketed in the early stage of the design process. It forms a hyperbolic band in the $F,\beta\lambda^3$ space, as illustrated by FIG. 6.

Horizontal (sequence) bands which intersect the hyperbolic ($E_oT\lambda C$) band within the range of $\beta\gamma^3$ of interest, are candidates for use. The F, $\beta\gamma^3$ space graphically demonstrates the basic sequences and excitations applicable to given accelerator applications.

For example, a 400 MHz ($\lambda$=0.75 meters) proton linac with $E_oT$ at or below 4 MV/meter is constrained to the region below the $E_oT\lambda C$ hyperbola for 3 MV. Dropping too far below this excitation may result in excessive accelerator length. The design might therefore be constrained to the hyperbolic band between the hyperbolae for 2 and 3 MV. Acceleration from 250 keV to 10 MeV suggests the need to employ several basic sequences in order to span the indicated range of horizontal parameter.

To design a practical APF linac from the building blocks of Table 1 is to adopt a favorable sequence and F value, and scale it precisely according to the scaling law. This implies tilting $E_oT$ as $\beta\gamma^3$, which for long structure may imply too low a field in the beginning or too high a field at the end.

Another design approach is to adopt a favorable sequence and F value for the low energy end of interest, and scale it according to the scaling law until the fields reach some practical limit, after which the fields are bounded at that limit. This implies a droop in F value after the electric fields have limited, but in many cases, suitable performance is observed.

From the point of view of acceleration and beam dynamics, heavy ions differ from protons by only the factor C, the charge per nucleon as compared to the proton. This factor is unity for protons, and considerably less than unity for heavy ions.

The injection energy per nucleon (MeV) is C times the injector voltage (MV). The final energies of heavy ion accelerators are often expressed in MeV/nucleon. The horizontal scale of the F, $\beta\gamma^3$ space can be used for heavy ion linac design by interpreting the energy scale as energy per nucleon. In general, heavy ion linacs deal with smaller values of energy per nucleon than normal for proton linacs.

For the same $E_oT$'s and $\lambda$'s, the $E_oT\lambda C$ hyperbolae lie considerably closer to the origin for heavy ion applications than for proton linac applications.

These effects combine to force heavy ion linac design into the range of smaller F values, and hence longer periodicities.

Referring now to FIG. 1, an injector 11 provides a low energy proton 250 keV beam to an alternating phase focused linac structure 12. The injector includes a proton ion source 13, a buncher cavity 14 and a solenoid lens 15.

Figure 2:
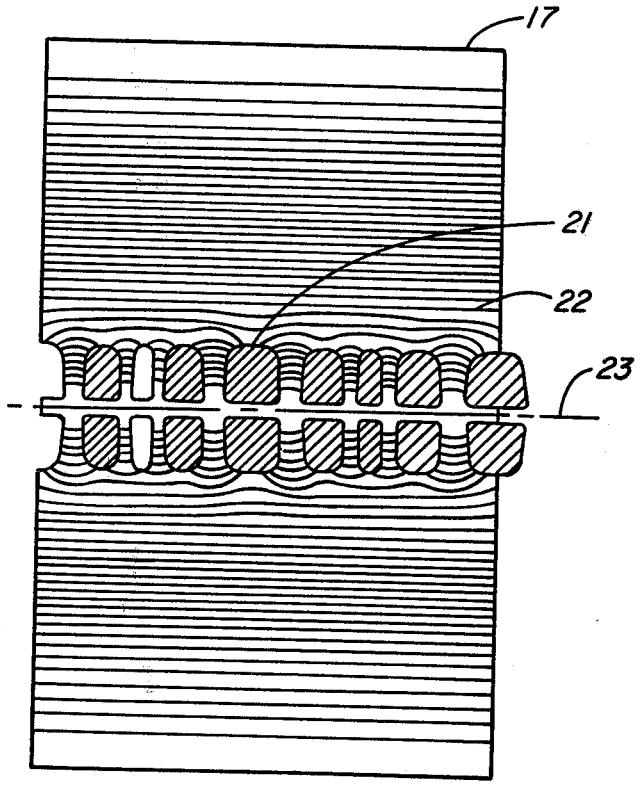
FIG. 2 illustrates the details of the drift tube shapes and the electric field in the vicinity of the drift tubes.

A suitable rf power source 16 operating exemplarily at 450 MHz, supplies rf energy to linac cavity structure 17. The rf field in resonant cavity 17 is injected by means of coaxial line 21 to provide the resonant cavity with a TM 010 mode field therein. Within the cavity are supported in any convenient manner a large number of drift tubes, such as drift tube 21. In FIG. 2 the generally toroidally shaped drift tubes such as 21 are illustrated in cylindrical resonant cavity 17. In addition, the shape and distribution of the electric field lines 22, about the drift tubes, are illustrated. Charged particles, exemplarily protons, from injector 11 travel through the centers of the toroidal drift tubes along the axis 23.

Figure 3:
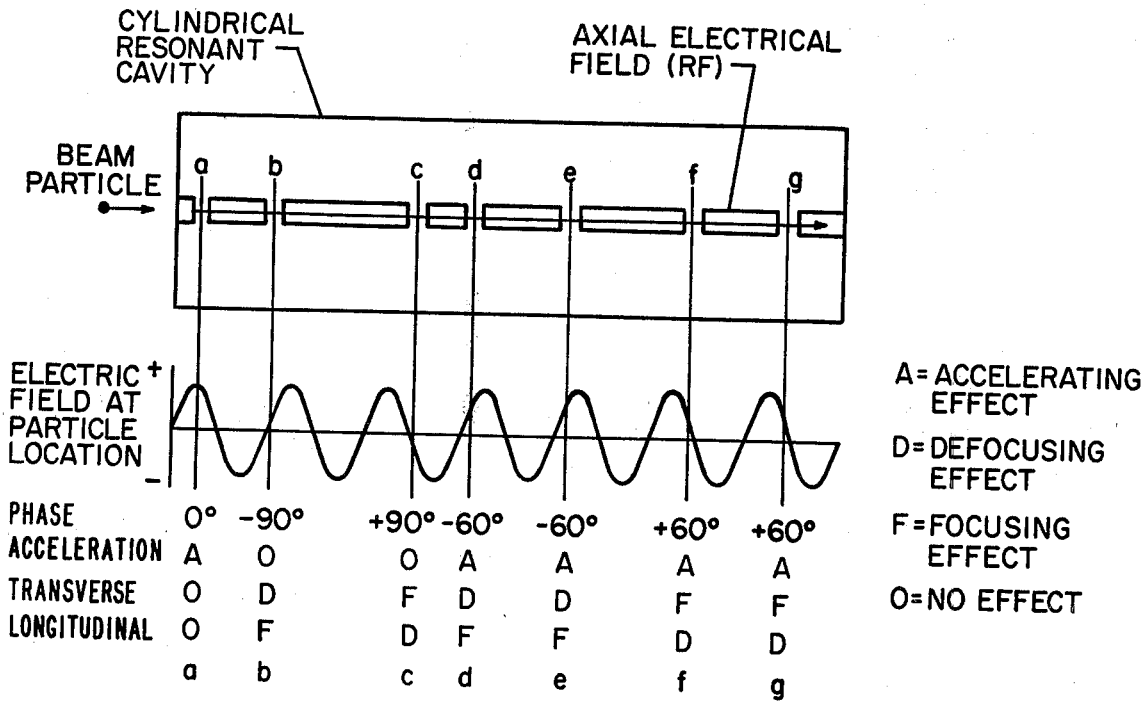
FIG. 3 illustrates the alternating phase focusing principle in connection with the phase of the rf field.

In FIG. 3 the relationship between the electric field in the cylindrical resonant cavity with the gaps between drift tubes is illustrated. As will be apparent from FIG. 3 the drift tube lengths are arranged so that the gaps therebetween fall at particular phase relationships of the electric field of the TM 010 mode resonant cavity. A group of seven sequential gaps is illustrated. Assuming the phase of the field at gap A is 0° the field tends to accelerate the protons but has no transverse or longitudinal focusing effect. At gap B, the rf field is at zero, but the phase with relationship to that at gap A is −90°. As illustrated in the drawing, gap B is actually 270° from gap A but the phase of gap B is −90° with respect to the phase of the field at gap A. At −90°, there is no acceleration of the protons. There is a transverse defocusing effect and a longitudinal focusing effect. At gap C, the field is +90°; with respect to the field at gap A at +90° there is also no proton acceleration but there is transverse focusing and some longitudinal defocusing. Gap D is placed at a point in the field −60° in phase from gap A. At −60° there is proton acceleration, transverse focusing, and longitudinal focusing. Gap E is also placed at −60° in phase relationship to gap A, and also provides proton acceleration, some transverse defocusing and longitudinal focusing. Gaps F and G are both placed at +60° with respect to gap A in the field. At +60° there is further proton acceleration in both gaps, transverse focusing and longitudinal defocusing in both gaps.

Figure 4:
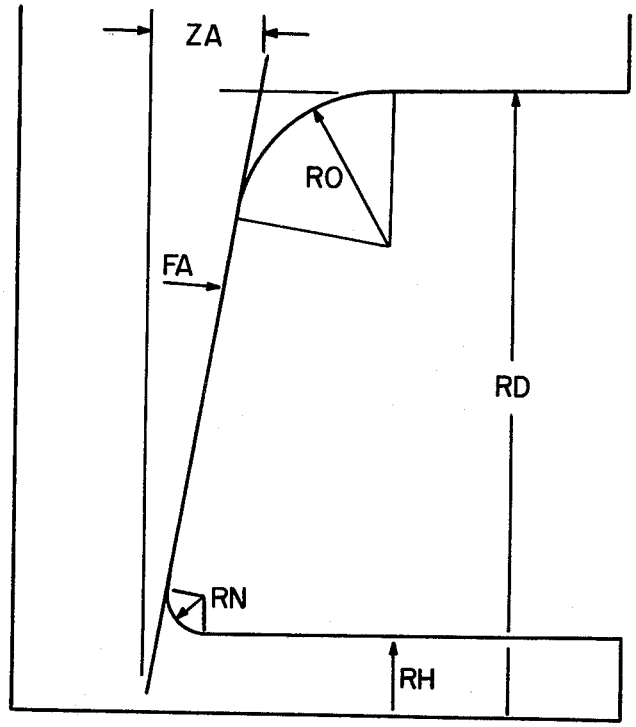
FIG. 4 shows the contour of the drift tube faces.

Each toroidal drift tube is symmetrical about its midplane, and is supported by one or more stems, not shown, in the plane of symmetry. The portion of the structure between the midplanes of adjacent drift tubes is referred to as a unit cell. Each unit cell has a gap region, the space between the drift tube faces, wherein the rf field operates upon the protons. Each gap region is approximately symmetrical about the center of the minimum gap. Since the rf field is symmetrical about the same center, the peak voltage on the gap is equal to the product of the average axial electric field times the cell length. The longer drift tubes have a cross section that is essentially trapizoidal with rounded corners. The drift tube faces are offset from the plane normal to the axis by a face angle (FA) as illustrated in FIG. 4. The conical face is blended to a cylindrical midsection of radius RD by an outer corner of radius RO. The center of the drift tube is apertured by a bore hole of radius RG which blended to the drift tube face with a nose radius RN. At 450 MHz the geometrical values of these quantities are conveniently FA=10°, RD=4 cm, RO=1 cm, RN=¼ cm and RH=½ cm. These dimensions define a standard face contour which may be employed for the longer drift tubes of the structure. However, the shortest cells vary from the shape defined hereinabove.

It will be apparent that a face angle, such as FA, must be accompanied by a reduction in the gap length in order to maintain à fixed frequency. As the gap length of a given cell is reduced, the voltage gradient on the drift tube surface is increased. For the longer cells, a 10° face angle has very little effect on the gap length and surface fields. However, for the shortest cells, the fractional effect of a 10° face angle is major and unacceptable. For these shortest cells, the face angle effects can be minimized by reducing the tangent of the face angle in proportion to the gap length below a critical gap length. Referring to FIG. 4 let ZA be the dimension defined by the relation ZA=RD tan FH. This is approximately the change in the half width of the gap across the drift tube face as a result of the face angle FA. The face angle constraint can be defined in the terms of the ratio ZA/(G/2). Exemplarily, this ratio should be $\leqq 1$. For the longer cells and gaps, the standard face angle of 10° satisfies the constraint by yielding the value of ZA<G/2. For the shorter cells and gaps, the face angle must be reduced to maintain the equality ZA=G/2. While satisfying this face angle constraint, resulting from gap geometry considerations, in some cases the drift tube body is too short to accommodate the two face angles and the two outer corner radii RO. In this case, RO is reduced to fit the drift tube body. Because of the exact symmetry required on the drift tubes and the approximate symmetry required on the gaps, the face contours must be similar throughout the alternating phase focusing period, but can undergo a slow monotomic evolution in shape toward the standard face contour as the particle velocity increases. Consequently, the face angle constraint must be satisfied for the shortest gap in any particular alternating phase focusing period. The corner radius restraint occurs less frequently, and has less effect on a resonant frequency. Therefore, a corner radius may be made smaller where necessary. Thus, symmetry of the corner radius across the gap is not essential. However, corner radius symmetry is maintained as much as possible on the drift tube body.

It will be apparent therefore, that for the shorter cells in the structure there is a two dimensional array of possible shapes, that is, a range of cell lengths and for each cell length a limited range of face angles. For the longer cells the array of possible shapes is reduced, since the range of face angles converges on the standard face angle of 10°. However, even here there is a range of possible velocities for the synchronous particle, depending upon the position of the cell within the alternating focusing period.

The actual physical dimensions of the cell are represented by the ratio of the total cell length L to wavelength λ and an average velocity $\bar{\beta}$. $L/\lambda=(L_1+L_2)/\lambda$ and $\bar{\beta}=L/(L_1\bar{\beta}_1+L_2/\bar{\beta}_2)$; wherein $L_1$ is the distance from the beginning of the cell to the center of the gap, $L_2$ is the distance from the center of the gap to the end of the cell, $\bar{\beta}_1$ is the velocity of the particle before entering the gap and $\bar{\beta}_2$ the velocity of the particle after leaving the gap.

Figure 5:
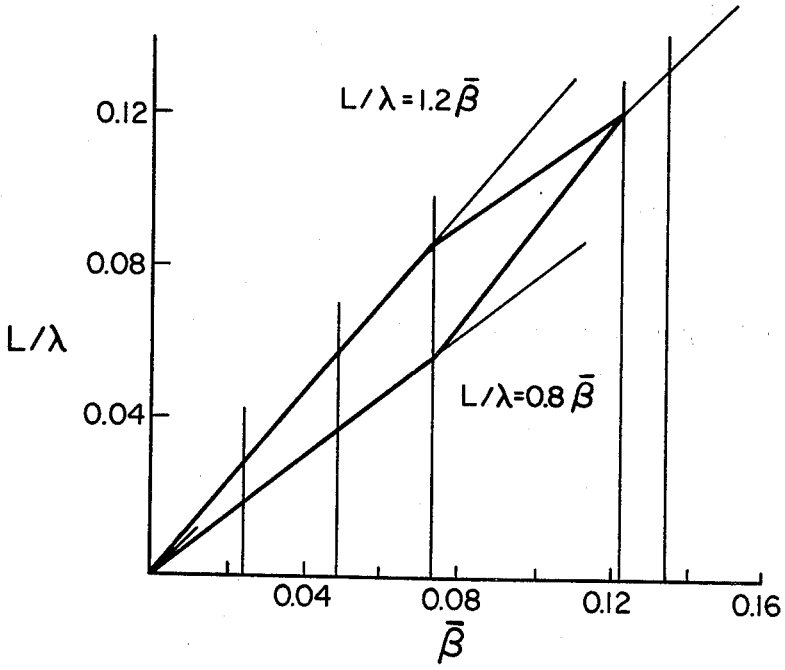
FIG. 5 is a diagram of the relationship between $L/\lambda$ and $\bar{\beta}$.

The relationship between L/λ and $\bar{\beta}$ is illustrated in FIG. 5. In the conventional drift tube linac $L/\lambda=\bar{\beta}$, and falls on a single straight line. In the linac of the present invention, the cell lengths oscillate about the value of $\bar{\beta}\lambda$ with the period of the alternating phase focusing sequence, as $\bar{\beta}$ increases monotomically.

In the linac of the present invention, the cell length oscillates about 20% above and below the average value of $\bar{\beta}\lambda$. These variations fall on lines having slopes of 1.2 and 0.8 in FIG. 5.

All of the cells lie substantially adjacent the boundaries indicated by FIG. 5. The diamond pattern is sliced vertically at selected values of $\bar{\beta}$, and the two geometries corresponding to the intersections with the bottom and top halves of the diamond are selected. Given L/λ and $\bar{\beta}$, the values of G/L and T may be determined. The half lengths of the drift tubes are $L_1$-G/2 and $L_2$-G/2, which can be used to determine the outer corner radius if either half drift tube in the cell violates the corner radius contrast discussed hereinabove.

In the alternating phase focusing linac, the cell lengths vary about the value of $\bar{\beta}\lambda$ with the period of the alternating phase focusing sequence as $\bar{\beta}$ increases. The cell length oscillates about 20% above and below the average value of $\bar{\beta}\lambda$. This variation in cell length corresponds to the L/λ of equal 1.2 $\bar{\beta}$ and $L/\lambda=0.8\ \bar{\beta}$ in FIG. 5. If $\bar{\beta}$ is held constant in FIG. 5 interpolation along the axis corresponds to interpolation between cell geometries of different lengths all of which however have the same face angle. On the other hand, interpolation along a horizontal line that is L/λ being held constant corresponds to interpolation between cell geometries of the same length with different face angles.

As pointed out hereinabove, the face angle constraint is based on the gap dimension of the shortest cell in the alternating phase focusing period. The shortest cells lie on the line $L/\lambda=0.8\ \bar{\beta}$. The diameter of the resonant cavity is selected so that the value $G/L\simeq 0.25$. The minimum gap in the alternating phase focusing period is then $\sim G_{min}=0.2\times 0.8\ \bar{\beta}\lambda=0.16\ \bar{\beta}\lambda$. In accordance with the face angle constraint FA must be less than or equal to $FA_{max}$ given by $FA_{max}=\tan^{-1}[G_{min}/2RD]=\tan^{-1}[1.3324\bar{\beta}]$. $FA_{max}=10°$ for $\bar{\beta}=0.132$. Conveniently $FA=FA_{max}$ for $\bar{\beta}<0.132$ and FA=10° for $\bar{\beta}\geqq 0.132$. This value of $\bar{\beta}$ corresponds to the $\bar{\beta}$ near the end of the stack. The average value of $\bar{\beta}$ in one cell may be expressed through the parameter $\Delta\phi$.

It will be noted that acceleration per cell of heavy particles in the present invention is not as great as in non-conventional linac structures. Therefore, a transition zone to a conventional linac structure may be provided. Referring to FIG. 5, between $\bar{\beta}\approx 0.05$ and $\bar{\beta}\approx 0.075$ a quad range transition is provided wherein quadrupole focusing magnets are also provided. Between $\bar{\beta}\approx 0.075$ and $\bar{\beta}\approx 0.12$ a phase range section is provided. Beyond $\bar{\beta}\approx 0.12$, conventional linac structure provides the desired final energy to the particles.

The various features and advantages of the invention are thought to be clear from the foregoing description. However, various other features and advantages not specifically enumerated will undoubtedly occur to those versed in the art, as likewise will many variations and modifications of the preferred embodiment illustrated, all of which may be achieved without departing from the spirit and scope of the invention as defined by the following claims.

What I claim is:

1. A linear accelerator structure comprising:

an evacuated tank structure;

radiofrequency generating means for providing a standing wave in said evacuated tank structure;

particle injection means for injecting a beam of charged particles into said evacuated tank structure;

a plurality of spaced apart drift tubes, adjacent halves of said drift tubes and the gaps therebetween forming cells aligned to cooperate with said beam of charged particles, the length of said cells being asymmetric and varying periodically with respect to the wavelength of the starting wave in said tank structure; and, spacing said gaps successively at standing wave phase angles of 0°, −90°, +90°, −60°, −60°, +60° and +60°, respectively.

* * * * *